United States Patent [19]

Butterfield

[11] Patent Number: 4,817,580

[45] Date of Patent: Apr. 4, 1989

[54] COMPOUND BOW

[76] Inventor: Waldo K. Butterfield, Butterfield La., Stratham, N.H. 03885

[21] Appl. No.: 202,327

[22] Filed: Jun. 6, 1988

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 3,923,035 | 12/1975 | Trotter | 124/24 R |
| 3,987,777 | 10/1976 | Darlington | 124/23 R |
| 4,077,385 | 3/1978 | Fredrickson | 124/24 R |
| 4,203,412 | 5/1980 | Richard | 124/23 R |
| 4,461,267 | 7/1984 | Simonds et al. | 124/23 R |
| 4,478,202 | 10/1984 | Anderson | 124/23 R |
| 4,562,824 | 1/1986 | Jennings | 124/23 R |
| 4,683,865 | 8/1987 | Troncoso | 124/24 R |
| 4,705,015 | 11/1987 | Troncoso | 124/24 R |
| 4,718,397 | 1/1988 | Remick | 124/23 R |
| 4,757,799 | 7/1988 | Rozek | 124/23 R |

*Primary Examiner*—Randolph A. Reese
*Assistant Examiner*—John A. Ricci
*Attorney, Agent, or Firm*—William Nitkin

[57] ABSTRACT

A compound bow is disclosed with the improvement of a leaverage-increasing structure having a pair of rotatable wheels mounted on the bow above and below the handgrip thereof with a first and second cable member attached to and extending around each of the wheels respectively and further extending to and attached to the bowstring above and below the point of arrow notch engagement. A first and second crank extending through the central axis of the wheels, such cranks having an offset portion interconnected with a third and fourth cable attached to the opposite bow limb ends, pull such bow limb ends inward upon the pulling of the bowstring and the rotation of the first and second wheels by the movement of the first and second cables. Upon the full drawing of the bow, tension on the third and fourth cables is released and the first and second wheels are rotated back to their original positions.

4 Claims, 4 Drawing Sheets

COMPOUND BOW

BACKGROUND OF THE INVENTION

1. Field of the Invention

The device of this invention resides in the area of archery bows and more particularly relates to an improved compound bow for pulling the ends of the limbs of the bow inward with significantly increased leverage when pulling back the drawstring of the bow.

2. Description of the Prior Art

Compound bows are well known in the prior art. These bows use pulleys and riggings to produce torque on the bow limbs when the bow is drawn. Such pulley and rigging systems provide an advantage to the user in that they allow the pulling of the bowstring to tension the bow with less force than would otherwise be necessary to draw the bowstring. One can also maintain the bow in a fully drawn position with reduced force than would otherwise be needed without the compound structures on the bow.

U.S. Patents of interest in this field are: U.S. Pat. Nos. 3,595,213, Storer; 3,987,777, Darlington; 4,078,537, Carella; 4,192,280, Rickard; 4,340,025, Caldwell; 4,368,718, Simonds et al; 4,440,142, Simonds; 4,455,990, Barna; 4,515,142, Nurney; 4,593,674, Kudlacek; 4,599,986, Nishioka; 4,599,987, Rezmer; 4,603,676, Luoma; 4,612,906, Troncoso; 4,628,892, Windedahl.

SUMMARY OF THE INVENTION

It is an object of this invention to provide a structure on a compound bow of the type using pulleys and like equivalents whereby a pair of wheels utilizing the system of this invention provides significant leveraged force when drawing the bow to pull the ends of the bow limbs of the bow inward so as to increase significantly the motive force on the bow string when the bow is fully drawn without the need for applying equally corresponding force to draw back the bowstring. The advantages of the system of this invention will become clearer with reference to the drawings and description as provided below.

DESCRIPTION OF THE PREFERRED EMBODIMENT

Figure 1:
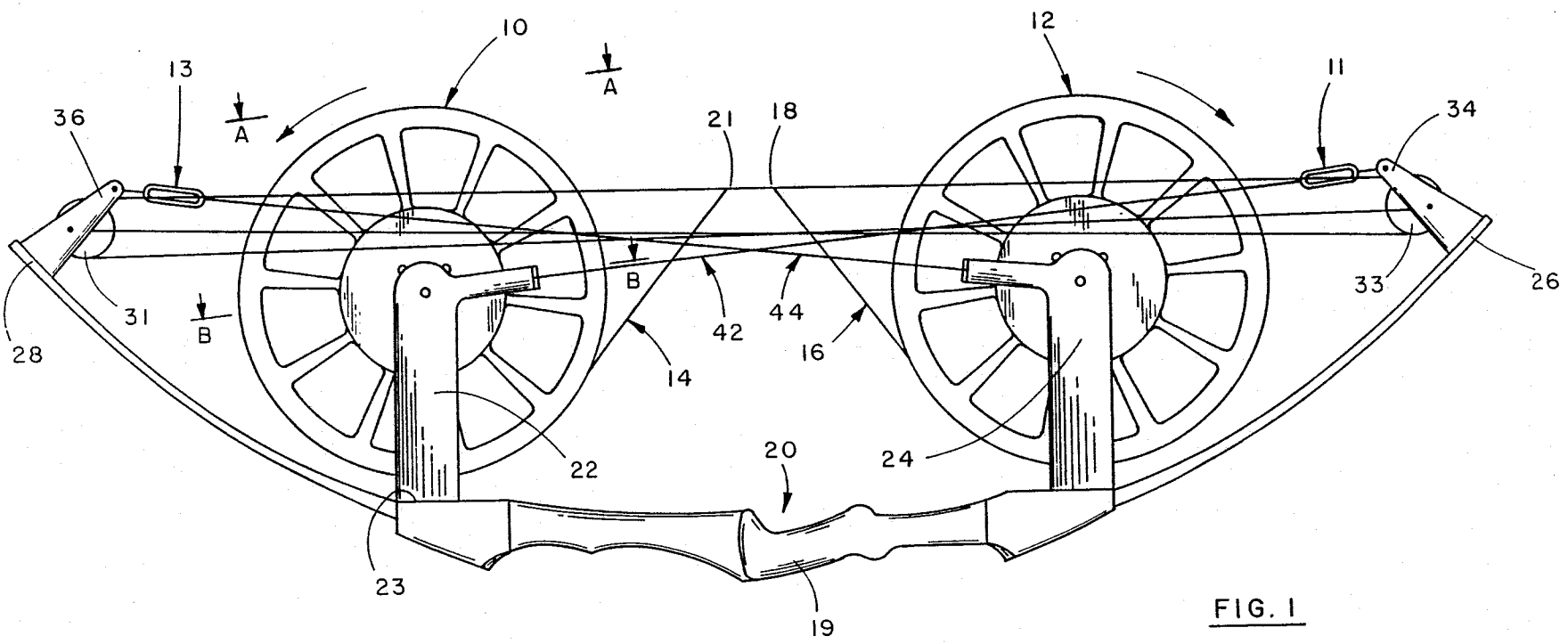
FIG. 1 illustrates a side view of a bow utilizing the dual wheel leverage system of this invention.

FIG. 1 illustrates a side view of bow 20 of this invention utilizing a pair of large wheels 10 and 12. In this view wheels 10 and 12 are mounted on front brackets 22 and 24 which are seen at both ends of hand grip portion 19 of the bow and offset from bowstring 18. These wheels are utilized during the drawing of bowstring 18 to help pull ends 26 and 28 of bow 20 inward as bowstring 18 is drawn so that the user does not have to apply significant force to bowstring 18 to pull in the ends 26 and 28 of the bow limbs of bow 20 inwards when the bow is fired. It should be noted that in describing one of the wheels the other wheel operates similarly but rotates in the opposite direction.

Figure 3:
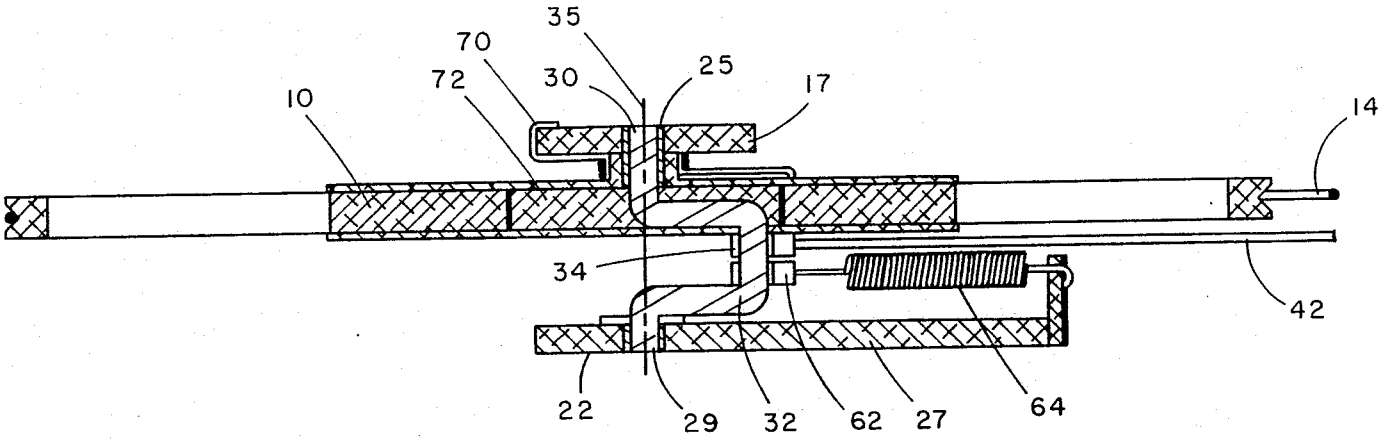
FIG. 3 illustrates a cross-sectional view through Section B—B of FIG. 1.
Figure 2:
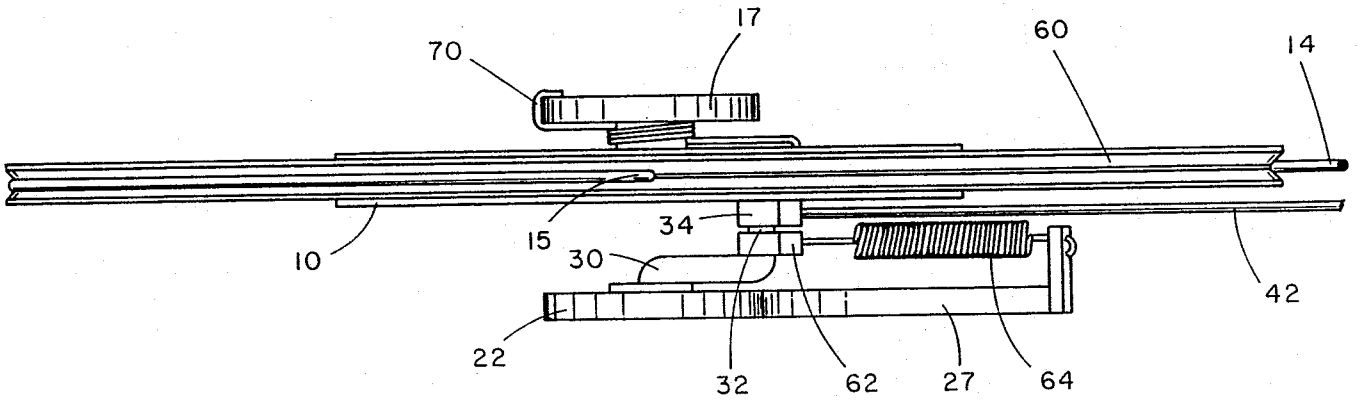
FIG. 2 illustrates a top view of Section A—A of FIG. 1.
Figure 4:
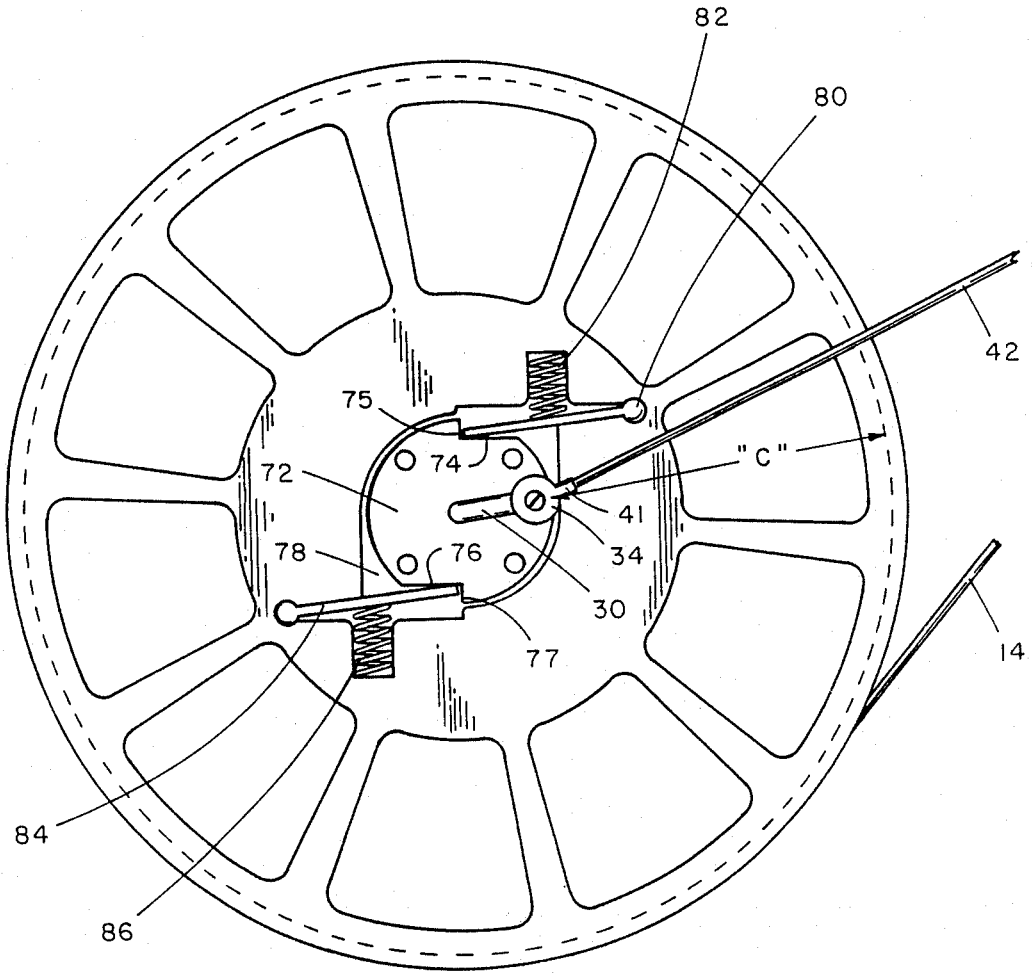
FIG. 4 illustrates a side view of a wheel opened with the dogwheel in a first position.
Figure 5:
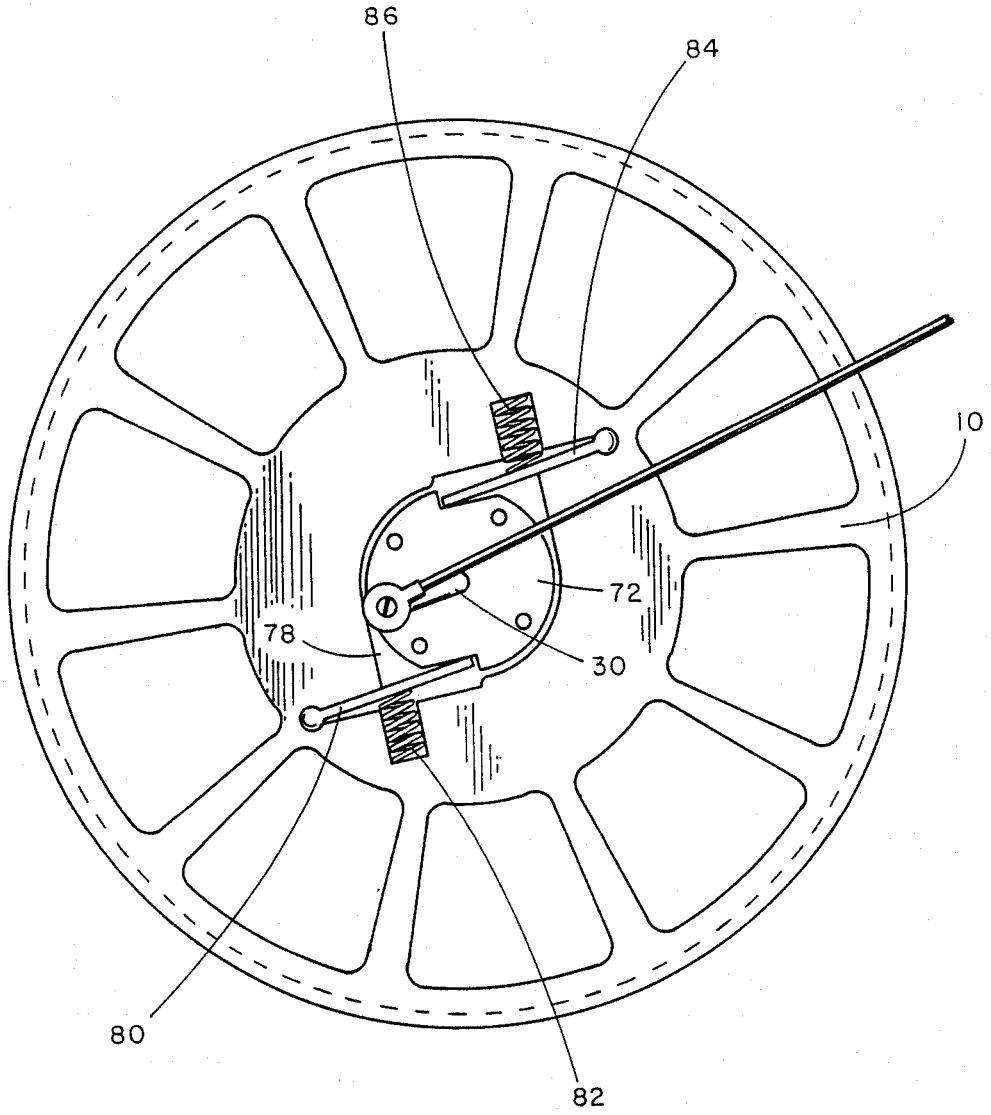
FIG. 5 illustrates a view of the wheel of FIG. 4 with the dogwheel in a second position.

Wheel 10 as seen in FIG. 2 which is a top view of section A—A of FIG. 1 has channel 60 disposed around its outer edge within which cable 14 travels which cable is attached to bowstring 18 at attachment point 21 as seen in FIG. 1 and is further attached within channel 60 at attachment point 15 as seen in FIG. 2 so that when bowstring 18 is pulled, cables 14 and 16 rotate each of wheels 10 and 12 respectively a distance until bowstring 18 is fully drawn and ready for shooting. In doing so, actions take place within the wheels to gain leverage forcing bow ends 26 and 28 of bow 20 inward. Wheel 10 is held in place by crankshaft 30 which passes through the center of wheel 10 and which crankshaft 30 has its ends disposed in opposing apertures 25 and 29 in brackets 17 and 22 as seen in FIG. 3 which brackets 17 and 22 are attached to bow 20 at their bases such as at bracket attachment point 23 with bracket 17 attached similarly to the opposite side of bow 20. Crankshaft 30 can rotate freely in apertures 25 and 29 and can have bearings or bushings therearound to promote such free movement. Within the center of each wheel is an aperture 78 containing a rotatable dogwheel 72 as seen in FIGS. 3, 4 and 5 which is held in a first position by a pair of pawls 80 and 84 which are forced by springs 82 and 86 to engage into notches 74 and 76 in dogwheel 72 so as to prevent rotation in one direction yet to allow rotation in the other. Crankshaft 30 is securely affixed in dogwheel 72. Notches 74 and 76 are disposed 180 degrees apart from one another on dogwheel 72. Dogwheel 72 is rotatably mounted within wheel aperture 78 defined within wheel 10. Crankshaft 30, as seen in a cutaway view of FIG. 3, has a central portion 32 offset a distance so as to form a U-shape between the shaft portions rotatably engaged in apertures 25 and 29 in brackets 17 and 22 so that extending from bracket 17 the crankshaft's shape returns to the same central axially aligned position 35 to where it rotatably attaches to aperture 26 in bracket 22. In this way crankshaft 30 allows wheel 10 to rotate on an axis aligned with apertures 25 and 29 in brackets 17 and 22 but yet as it does so, central portion 32 of crankshaft 30 is offset from the central axis 35 of wheel 10 and apertures 25 and 29 in brackets 17 and 22. Central portion 32 of crankshaft 30 is positioned to extend not further than the perimeter of dogwheel 72 so it that will not strike the inside of wheel aperture 78 in wheel 10. Further the positioning of the central portion 32 of crankshaft 30 in relation to dogwheel 72 is approximately midway on the circumference between notches 74 and 76 but slightly closer to notch 76 a few degrees above a horizontal line drawn through wheel 10. To this offset central portion 32 is attached rigging cable 42 which extends out to turnbuckle 11 by which it is attached to bow end 26 of the blow limb. Rigging cable 42 is attached to offset central portion 32 of crankshaft 30, which central portion 32 in crosssection is round, by an eyebolt-type connector 34 seen in FIGS. 2, 3, 4 and 5, the eye of which fits around offset central portion 32 in such a way that crankshaft 30 can rotate therein with rigging cable 42 attached to shaft 41 of eyebolt 34. In this way when bowstring 18 is drawn, the rotation of crankshaft 30 by wheel 10 pulled by cable 14 is leveraged by a factor of 8 to 1 due to the outer diameter of the wheel being much greater than the diameter of travel of the central portion 32 of crankshaft 30. The rotation of crankshaft 30 is caused by the pulling of bowstring 18 and the movement of cable 14 pulls rigging cable 42 by the movement of the offset central portion 32 of crankshaft 30 so as to pull bow end 26 inward due to the rotational action of wheel 10. Bow end 28 of bow 20 is pulled inward by similar action of wheel 12 and its crankshaft attached to its rigging cable 44. Turnbuckle 11 can be used to adjust the tightness and length of rigging cable 42. In this fashion when the bow is pulled, great leverage is applied because force is applied at the outside of wheel 10 the distance "C" indicated in FIG. 4 between the exterior channel 60 of wheel 10 and offset central portion 32 of crankshaft 30. This leverage multiplies the force exerted on the bowstring to exert 8 times that force in pulling the bow limb ends inward. When bowstring 18 is fully drawn and the bow is in a shooting position, it is advantageous to then eliminate the tension on the bow ends 26 and 28 from rigging cables 42 and 44 and allow bowstring 18 to then be easily retained by compound wheel members 31 and 33 in its fully withdrawn position but with the significant increase in tension which compound members 31 and 33 will then hold until the bow is fired without such tension being felt by the user.

The dual wheel system of this invention allows the drawing inward of bow ends 26 and 28 to a much greater degree than by the use of prior art compound pulleys and the like alone engaged with the bowstring. When bowstring 18 is fully drawn, as mentioned above, the tension should be released so that wheels 10 and 12 do not exert any force or interfere with the action of the ends of the bow limbs now exerting great tension or the bowstring to propel the arrow forward at great velocity.

To release the tension on wheels 10 and 12 when the bowstring is fully withdrawn, a system is utilized whereby when wheel 10 is rotated, dogwheel 72 is rotated as well by the pushing of pawls 80 and 84 against the ends 75 and 77 of notches 74 and 76 and offset central portion 32 of crankshaft 30 is rotated 180 degrees due to the pulling of cable 14 attached to bowstring 18 rotating wheel 10. Once dogwheel 72 has been rotated 180 degrees, pawls 80 and 84 are no longer engaged with it as seen in FIG. 5 and dogwheel 72 can continue to rotate freely to return to its original position because offset central portion 32 has rotated to a point more than halfway around the wheel and pressure is now put on offset central portion 32 in the direction of the arrow on rigging cable 42 in FIG. 5 toward bow end 26 so as to pull dogwheel 72 around independently of wheel 10 back to its original position as seen in FIG. 4 because pawls 80 and 84 no longer engage against notches 74 and 76 in the position shown in FIG. 5. This movement of dogwheel 72 independent of wheel 10 releases the tension on rigging cable 42 which pulled the end of the bow limb inward. Such pressure is no longer needed when the bow is fully drawn as the compound wheel members 31 and 33 then hold the bow ends together until the bow string is released. The means to return dogwheel 72 from its second "release" position to its first "original" position once it has rotated 180 degrees, tensioned rigging cable 42, and then been released by pawls 80 and 84 can be a pulling force emanating from rigging cable 42 or an independent spring member as described below. As seen in FIGS. 2 and 3 spring 64 can be attached to an extended portion 27 of bracket 22 to pull dogwheel 72 back to its original position. This mechanism is seen in FIG. 3. An eyebolt-type attachment 62 such as the one used to hold cable 42 rotatably to offset central portion 32 of crankshaft 30 can be used. Spring 64 is attached at one end to eyebolt 62 which is rotatably mounted on crankshaft 30 and the other end of spring 64 is attached to bracket extension 27 of bracket 22 in the direction of rigging cable 42. By the pulling of dogwheel 72 back to its first "original" position, the tension on rigging cable 42 is completely released as dogwheel 72 and attached crankshaft 30 are returned to their original starting postion. Further, as seen in FIG. 2, when the bowstring is released, torsion spring 70 which is attached from bracket 17, coiled around crankshaft 30 and attached to wheel 10, rotates wheel 10 back to its original position as torsion spring 70 is oppositely tensioned somewhat during the wheel's rotation. The tensioning of torsion spring 70 is of a low degree as it merely must return the then freely moving wheel back to its original position to re-engage pawls 80 and 84 into notches 74 and 76 in dogwheel 72 so that the structure is ready for its next retensioning and firing.

In a further embodiment instead of spring 64 held by bracket extension 27 returning dogwheel 72 to its first position, an elastic cable section could be used as a portion of rigging cables 42 and 44 which elastic cable would pull dogwheel 72 back to its original position after it was rotated to its second "release" position while pulling back on the bowstring. If such a dogwheel return means were used, then spring 64 and bracket extension 27 would not be necessary on bracket 22. Further, in some embodiments a cable guard of soft rubber can be applied around the channel of each wheel to cause the bowstring cable to engage thereinto so as to retain by surrounding frictional engagement with soft rubber to remain on the periphery of the wheel. In some embodiments extension members 34 and 36 positioned beyond and inward of the bow ends could be utilized for further increasing the effective leverage of the wheels.

Although the present invention has been described with reference to particular embodiments, it will be apparent to those skilled in the art that variations and modifications can be substituted therefor without departing from the principles and spriti of the invention.

I claim:

1. A leverage-increasing device for use on a compound bow of the type having a pair of bow limbs on both sides of a handgrip area and a bowstring extending betweeen the bow limbs ends, said bowstring having a central point of arrow notch engagement, comprising:

a first and second bracket mounted on said bow, said first bracket disposed above said handgrip and said second bracket disposed below said handgrip:

a first and second wheel, each having a central axis, each rotatably mounted through their central axis on said first and second brackets respectively, said first and second wheels being mounted in an aligned position with said bow;

a first and second attachment member each interconnected with and positioned near said central axis of said first and second wheels respectively;

a first and second cable, each having a first and second end, each cable having its first end attached to a point on the outer periphery of each wheel respectively, each of said cables extending around a portion of the perimeter of each wheel and each cable attached at their second end to said bowstring one above and one below the point of arrow notch engagement adapted when said bowstring is pulled for said first and second cables to move rearward rotating said first and second wheels from a first position to a second position of rotation;

a third and fourth cable, each having a first and second end, each of said cables' first ends attached respectively to said first and second attachment members near the axis of each of said wheels, said third and fourth cables extending and having their second ends attached to each of said bow limb ends on the opposite side of said handgrip from said wheel to which said first cable end is attached respectively, said attachment members being rotated as said first and second cable are pulled when drawing the bowstring thus rotating said wheels to their second positions, such rotation causing said third and fourth cables to be pulled by said attachment member's movement, such third and fourth cable movement pulling the bow ends inward by the tension of such third and forth cable's pulling thereon;

release means to release the tension on said third and forth cables when the bowstring is fully drawn; and means to rotate said first and second wheels to their first positions after said tension of said third and fourth cables is released to rewind said first and second cables back around said first and second wheels.

2. The structure of claim 1 wherein the means to release tension of said third and fourth cables on the ends of the bow limbs comprise:

a first and second cavity respectively defined within a central portion of each of said first and second wheels;

a first and second dogwheel rotatably positioned within said first and second cavities respectively, each dogwheel having two open notches defined 180 degrees apart in said dogwheel's outer periphery;

a pair of pawls mounted on the sides of each of said first and second wheel's first and second cavities, said pawls protruding into said first and second cavities, each pawl engaged into one of said notches in said dogwheel in a first position to rotate each of said dogwheels upon the movement of said first and second wheels by the pulling of said bowstring;

a first and second crank forming each of said attachment members, each respectively attached to each of said first and second dog wheels, each crank adapted to pull said third and fourth cables to move the bow limb ends inward as said first and second wheels are turned when said bowstring is drawn and when the bow string is fully drawn, said notches in said dogwheel being rotated to a second position being released from engagement with said pawls releasing the pressure on said first and second cranks; and means to rotate said first and second dogwheels to their first positions in each wheel upon the release of engagement of said pawls.

3. The structure of claim 2 wherein said means to return said first and second dogwheels to their first positions after the rotation thereof to their second positions and release of said pawls from said notches in said dogwheels comprises a resilient portion of said third and fourth cables pulling said first and second cranks respectively to their first positions.

4. The structure of claim 2 wherein said means to return said first and second dogwheels to their first positions after the rotation thereof to their second positions and release of said pawls from said notches in said dogwheels comprise:

a first and second bracket extension member each extending from said first and second brackets, said first and second bracket extensions aligned with said third and fourth cables; and a first and second spring member attached from said first and second crank respectively to said first and second bracket extension members, said first and second spring members adapted to pull said crank from said second position when released from said pawls to said first position.

* * * * *